US006607330B2

(12) United States Patent
Philpott

(10) Patent No.: US 6,607,330 B2
(45) Date of Patent: Aug. 19, 2003

(54) SNOW COMPACTING TOOL

(76) Inventor: Patrick L. Philpott, P.O. Box 188, Haines, AK (US) 99827

( * ) Notice: Subject to any disclaimer, the term of this patent is extended or adjusted under 35 U.S.C. 154(b) by 0 days.

(21) Appl. No.: 09/951,430

(22) Filed: Sep. 14, 2001

(65) Prior Publication Data

US 2002/0034419 A1 Mar. 21, 2002

Related U.S. Application Data

(60) Provisional application No. 60/234,182, filed on Sep. 20, 2000.

(51) Int. Cl.[7] ..... E01C 19/26

(52) U.S. Cl. ..... 404/132; 404/122; 37/224

(58) Field of Search ..... 404/122, 125, 404/126, 127, 128, 132; 37/219, 223, 224, 231

(56) References Cited

U.S. PATENT DOCUMENTS

| | | | | | |
|---|---|---|---|---|---|
| 16,195 | A | * | 12/1856 | Thompson | 404/132 |
| 495,933 | A | * | 4/1893 | Farr | 404/125 |
| 941,770 | A | * | 11/1909 | Englund | 404/126 |
| 2,024,184 | A | * | 12/1935 | Ritchie | 404/132 |
| 2,270,390 | A | * | 1/1942 | Summers | 404/126 |
| 2,287,723 | A | * | 6/1942 | Boyd et al. | 404/122 |
| 2,407,965 | A | * | 9/1946 | Smith | 404/122 |
| 2,610,557 | A | * | 9/1952 | Bros et al. | 404/125 |
| 2,978,967 | A | * | 4/1961 | MacDonald | 404/125 |
| 3,783,949 | A | | 1/1974 | Maxey | |
| 3,878,900 | A | | 4/1975 | Boisse et al. | |
| 3,908,540 | A | | 9/1975 | Broman | |
| 4,019,268 | A | | 4/1977 | Waterman | |
| 4,021,942 | A | | 5/1977 | Purdy | |
| 4,056,328 | A | * | 11/1977 | Maxey | 404/96 |
| 4,145,824 | A | | 3/1979 | Watson | |
| 4,163,329 | A | | 8/1979 | Neff | |
| 4,244,662 | A | | 1/1981 | Olson | |
| 4,337,586 | A | | 7/1982 | Buono | |
| 4,348,825 | A | * | 9/1982 | Bachler | 37/222 |
| 4,549,364 | A | | 10/1985 | O'Connor | |
| 4,887,838 | A | | 12/1989 | Reppen | |
| 5,050,898 | A | | 9/1991 | Petrell, Jr. | |
| 5,272,883 | A | | 12/1993 | Matsui et al. | |
| 5,395,182 | A | * | 3/1995 | Rossburger | 404/122 |
| 5,680,715 | A | | 10/1997 | Thiboutot et al. | |

FOREIGN PATENT DOCUMENTS

| | | |
|---|---|---|
| GB | 275744 | 8/1927 |
| GB | 773163 | 4/1957 |

* cited by examiner

*Primary Examiner*—Gary S. Hartmann
(74) *Attorney, Agent, or Firm*—Richard C. Litman

(57) ABSTRACT

A multi-wheeled vehicle for compacting loose snow and frost comprises a frame structure having a rack portion for supporting extra weight. Each wheel of the vehicle is provided with a torsion spring arrangement such that each wheel can move independently in a vertical direction. A towing tung is connected to the frame structure so that the vehicle may be towed.

7 Claims, 5 Drawing Sheets

*Fig. 5*

SNOW COMPACTING TOOL

CROSS-REFERENCE TO RELATED APPLICATION

This application claims the benefit of U.S. Provisional Patent Application Serial No. 60/234,182, filed Sep. 20, 2000.

BACKGROUND OF THE INVENTION

1. Field of the Invention

The present invention generally relates to road construction equipment. More specifically, the present invention is drawn to apparatus for compacting snow and frost in the arctic tundra.

2. Description of Related Art

Pioneering construction in snow and frost covered arctic regions require that the oil companies, mining companies, government, etc. provide roads that are accessible to heavy equipment. Attempts to move the heavy equipment across areas of loosely packed snow and frost may result in severe damage or destruction of the tundra. To protect the tundra, it is necessary that the top surface is firmly packed so that the snow and frost will freeze hard to make a base for the construction of an "ice" road, thereby minimizing the damage to the tundra.

Devices for grooming slopes, roads and trails used by over-the-snow vehicles (skis, sleds, snowmobiles, etc.) are disclosed in U.S. Pat. No. 3,783,949 (Maxey), U.S. Pat. No. 3,878,900 (Boisse et al.), U.S. Pat. No. 4,019,268 (Waterman), U.S. Pat. No. 4,021,942 (Purdy), U.S. Pat. No. 4,163,329 (Neff), U.S. Pat. No. 4,244,662 (Olson), U.S. Pat. No. 4,337,586 (Buono) and U.S. Pat. No. 5,680,715 (Thiboutot et al.). The instant patents are not concerned with providing a stable road base for supporting heavy equipment such as tanker trucks, bulldozers, etc.

U.S. Pat. No. 3,908,540 (Broman) and U.S. Pat. No. 4,145,824 (Watson) show apparatus for removing and compacting snow into bales for disposal.

U.S. Pat. No. 4,549,364 (O'Connor) discloses a method of laying a snow road including removal of a certain amount of snow from a surface, melting the removed amount, and mixing the melted portion with the remaining snow or ice on the surface. This method requires heating means to melt the snow, which heating means obviously uses expensive energy.

U.S. Pat. No. 4,887,838 (Reppen) and U.S. Pat. No. 5,050,898 (Petrell, Jr.) show apparatus for attaching and removing a snow plow from a motor vehicle.

U.S. Pat. No. 5,272,883 (Matsui et al.) discloses a method and apparatus for maintaining snow quality on an indoor ski slope.

British Patent number 275,774 shows an implement for cultivating the soil.

British Patent number 773,163 discloses a machine for breaking up ice and compacted snow on road surfaces.

None of the above inventions and patents, taken either singly or in combination, is seen to disclose a snow and frost compacting device as will subsequently be described and claimed in the instant invention.

SUMMARY OF THE INVENTION

The present invention is drawn to a multi-wheeled vehicle adapted to be towed across the snow and frost-covered tundra of arctic regions. The vehicle is provided with a torsion spring-arm structure which permits each wheel to move independently in a vertical direction. Each wheel of the vehicle is equipped with a rugged tire capable of withstanding the rigors of the severe arctic environment.

A weight rack is disposed on the rear upper surface of the vehicle and is designed for balance and to support a load of up to one ton. The forward end of the vehicle is fashioned for attachment to the rear end of a pulling tung, which tung has a forward end adapted to be connected to a towing vehicle (truck, tractor, etc.).

In operation, the vehicle is towed across the loose snow and frost. The weight of the vehicle is distributed proportionately at each wheel (tire), thus translating the effect of the weight to compact the snow and frost atop the tundra surface. The independent vertical movement of the multiple wheels assures that the vehicle will easily adapt to the uneven surfaces presented by the tundra condition. The so-formed compacted surface provides a solid base for an ice road that will support any heavy construction equipment moving there over without causing major damage to the underlying tundra.

Accordingly, it is a principal object of the invention to provide a vehicle for compacting loose snow and frost atop the surfaces of the arctic tundra.

It is another object of the invention to provide a vehicle for compacting loose snow and frost, which vehicle is equipped with multiple wheels capable of independent vertical movement.

It is a further object of the invention to provide a vehicle for compacting loose snow and frost, which vehicle is equipped with structure for supporting additional weight as needed.

Still another object of the invention is to provide a vehicle for compacting loose snow and frost, which vehicle is equipped with a towing tung.

It is an object of the invention to provide improved elements and arrangements thereof in an apparatus for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
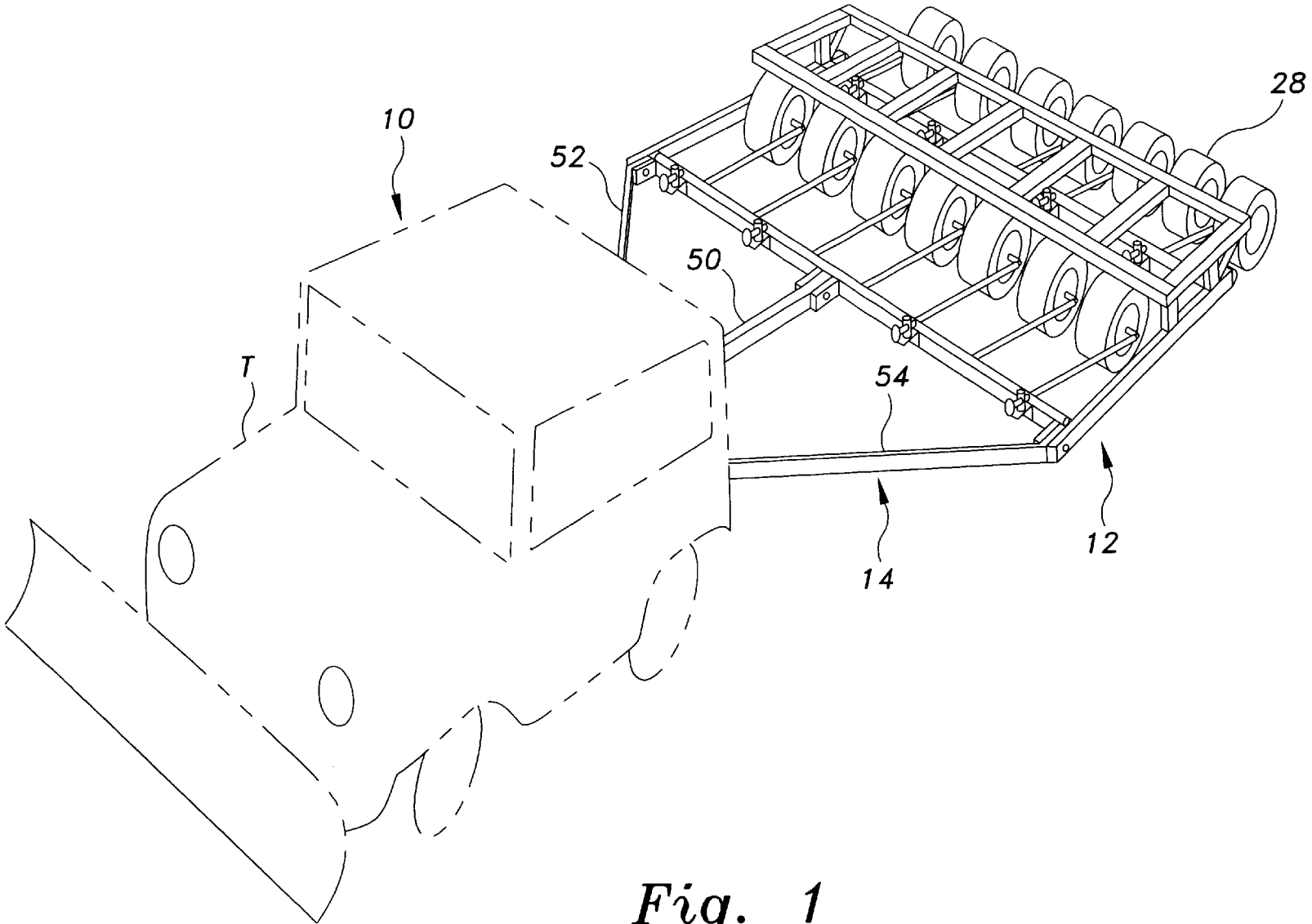
FIG. 1 is an environmental, perspective view of a snow compacting vehicle according to the present invention.
Figure 2:
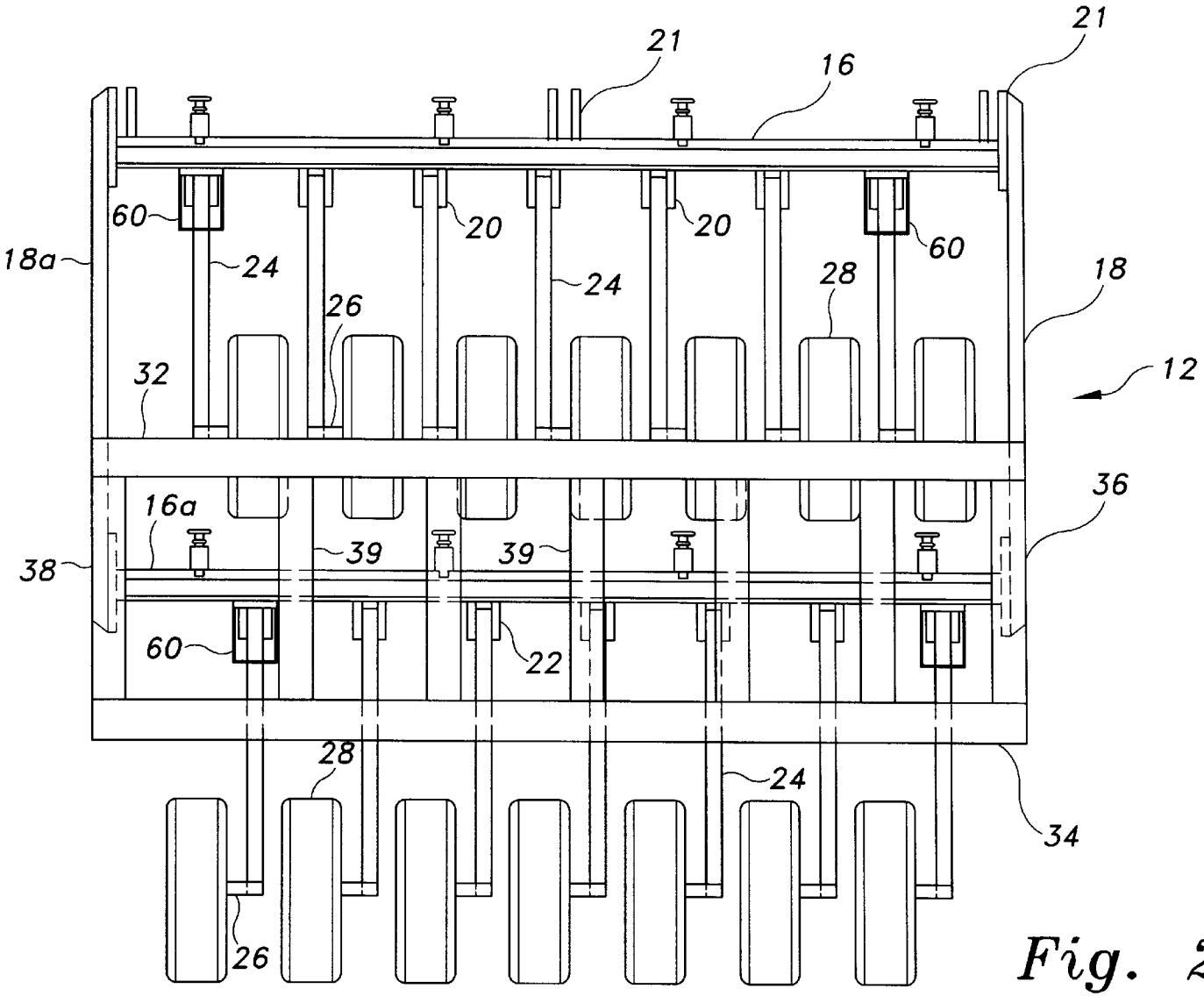
FIG. 2 is a top view of a frame structure of a snow compacting vehicle according to the present invention.

The present invention is generally indicated at 10 (FIG. 1) and comprises a frame structure 12 and a towing tung 14. As best seen in FIG. 2, frame structure 12 is of rectangular configuration having first spaced parallel sides 16, 16*a*. Second spaced parallel sides 18, 18*a* are attached to and extend perpendicularly from respective sides 16, 16*a*. As contemplated, sides 16, 16*a* are fabricated from 3×6×3/16 inch box tubing. Each side is approximately 12 feet long. Sides 18, 18*a* are made from 4×6×5/16 inch angle iron. Sides 16, 16*a*, 18, 18*a* are attached by any convenient and efficient means (welds, bolts, reinforcement plates, etc.) to form a stable, rugged support structure. A series of pivot plates 20 is securely positioned on a rear face of side 16. In like manner an identical series of pivot plates 22 is securely positioned on a rear face of side 16*a*.

Each series of pivot plates receives and has a first end of a wheel arm 24 pivotally supported therein. Each wheel arm has a second end rotatably connected to a respective axle 26. Each wheel arm is approximately four feet long. A wheel and tire 28 are supported for rotation on each respective axle 26. A series of pivot plates 21, whose function will be later explained, is securely positioned on a front face of side 16.

Figure 5:
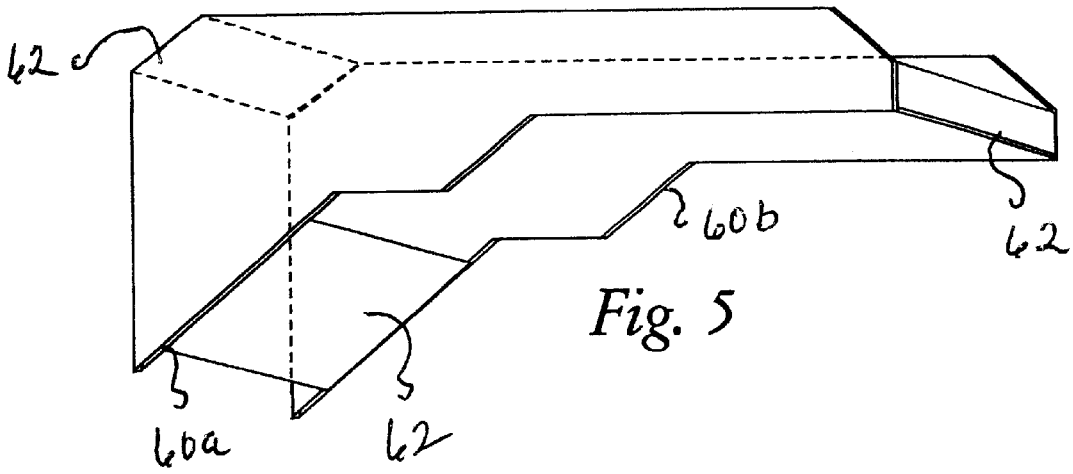
FIG. 5 is a perspective view of a back stop device of a snow compacting vehicle according to the present invention.
Figure 6:
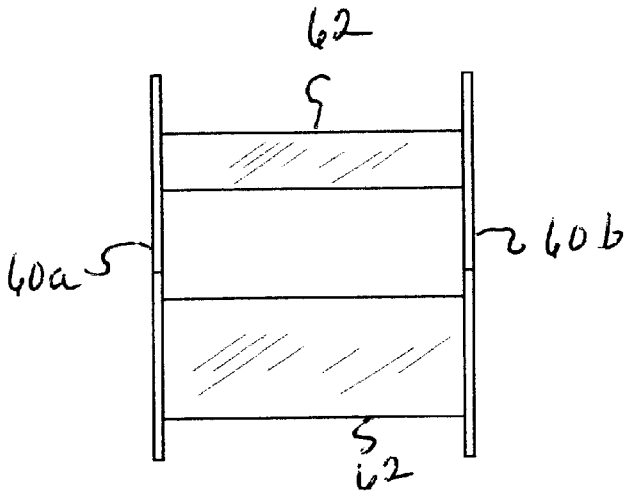
FIG. 6 is an end view of a back stop device of a snow compacting vehicle according to the present invention.

A back stop member 60 is positioned on each outside arm 24. The back stop member 60, as best seen in FIGS. 5 and 6, is an open structure having spaced side walls 60*a*, 60*b*. A plurality of rectangular plates 62 span the space between the side walls and are attached thereto. The sides and plates are fabricated from three-eights inch steel sheets. The back stop members are welded to the frame adjacent each of the four outside arms 24. The back stop members function to limit the vertical movement of the four outside arms so the frame will not come into contact with the tundra.

Figure 3:
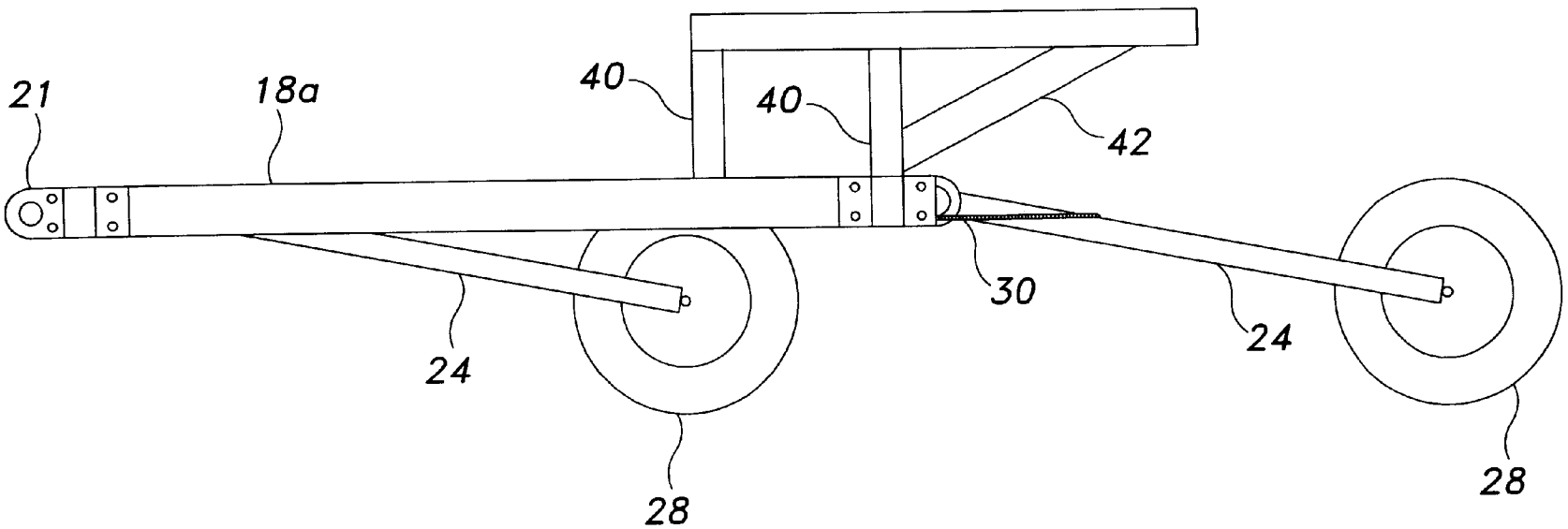
FIG. 3 is a side view of a frame structure of a snow compacting vehicle according to the present invention.

As best illustrated in FIG. 3, each wheel arm is provided with a torsion spring arrangement 30 (only one shown). Torsion spring 30 is biased in a downward direction. The torsion spring arrangement will permit each wheel to move independently in a vertical direction. As illustrated, there are two rows of tires each row having seven tires. The invention may be designed with more or less tires depending on the expected topography of the terrain to be traversed.

Figure 7:
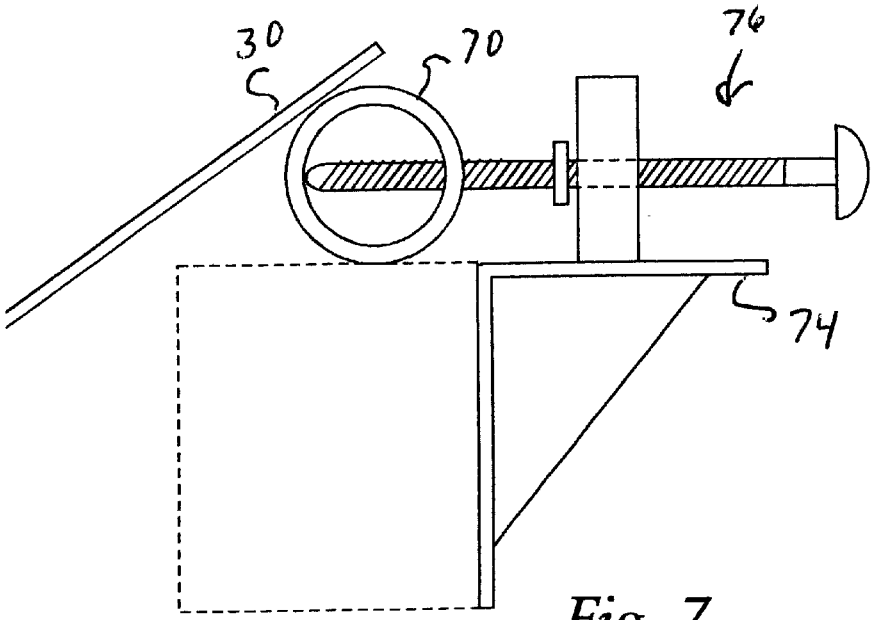
FIG. 7 is a side view of a tensioning bolt and bracket assembly of a snow compacting vehicle according to the present invention.

A two inch pipe 70 sets on the top surface of each frame member 16, 16*a*. Each pipe 70 is approximately ten feet long. A series of tensioning devices 72 are welded to each frame 16, 16*a* adjacent to each pipe. As best seen in FIG. 7 each tensioning device comprises a three-eights of an inch steel bracket 74 which is welded to the face of the frame member (shown in phantom lines). A tensioning bolt adjustment mechanism 76 is mounted atop bracket 74. The adjustment mechanism 76 functions to adjust tension of torsion spring 30 to different snow and tundra conditions and weight on the weight rack. Mechanism 76 pushes pipe 70 against torsion springs 30 making them stronger as needed.

A weight rack is affixed on the upper surface of frame structure 12. The weight rack is of rectangular configuration and comprises a first pair of spaced, parallel sides 32, 34. A second pair of spaced parallel sides 36, 38 are disposed perpendicularly to sides 32, 34 and are respectively attached thereto. A plurality of cross braces 39 are positioned perpendicularly to sides 32, 34 and are securely fastened thereto. The weight rack is vertically spaced from frame 12 and is supported on four legs 40 (FIG. 3—only two shown). A pair of braces 42 are provided to add support for the weight rack. The parts of the weight rack are attached by bolts in a manner to enable the rack to move forward and back for adjustment. The rack can retain concrete blocks having a total weight of up to two-thousand pounds.

Figure 4:
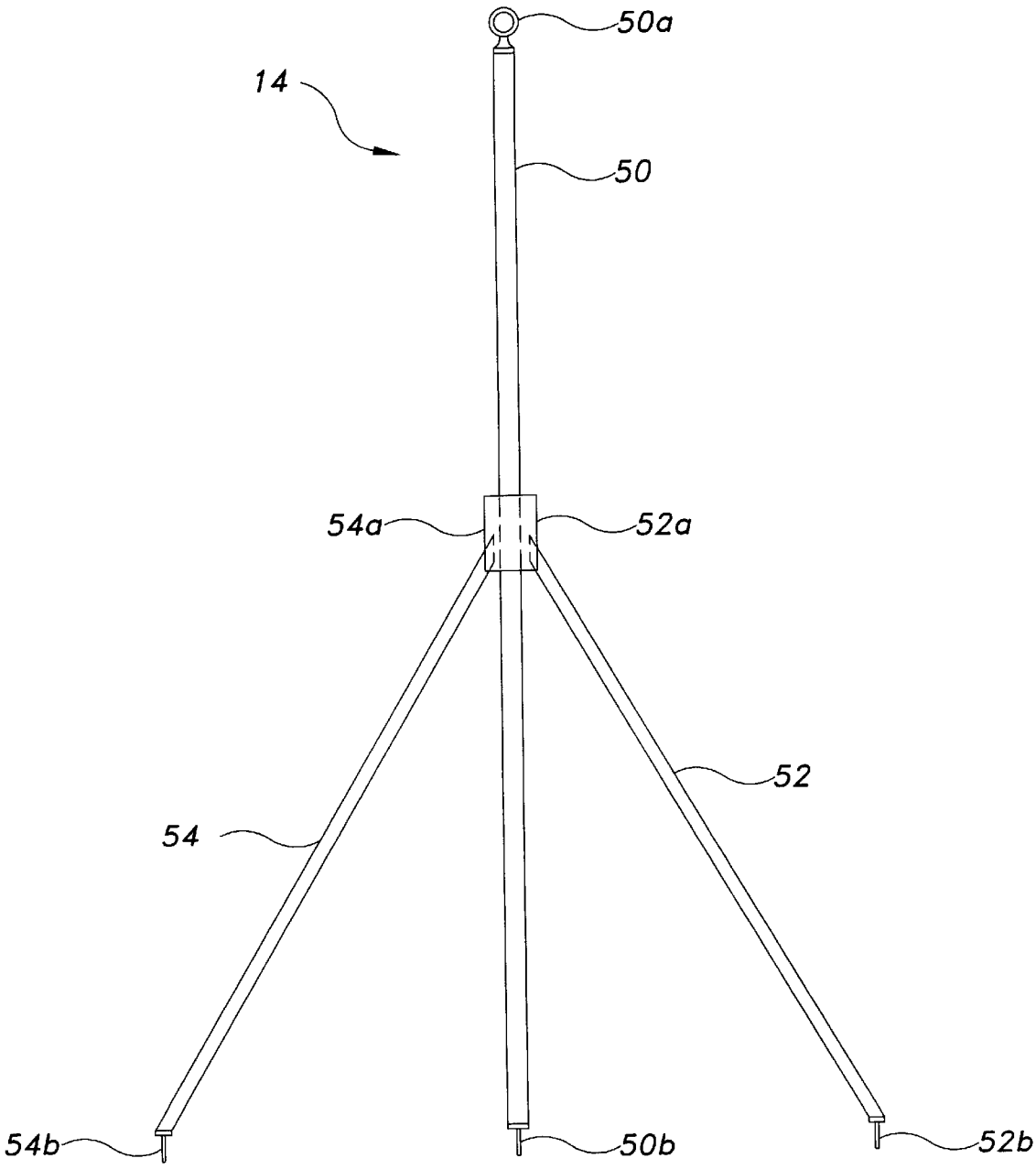
FIG. 4 is a top view of a towing tung of a snow compacting vehicle according to the present invention.

Attention is now directed to FIG. 4 which best illustrates the details of towing tung 14. Towing tung 14 comprises a shaft 50 approximately fifteen feet long. A first end of shaft 50 is provided with a hitch eye 50*a*. A pivot plate 50*b* is disposed on the other end of shaft 50. Hitch eye 50*a* and pivot plate 50*b* may be secured to the shaft by welds and/or bolts in a conventional manner. A pair of towing arms 52, 54 have first ends respectively attached (welded) to arcuate plates 52*a*, 54*a*. Pivot plates 52*b*, 54*b* are respectively attached to the second end of each towing arm 52, 54. Arcuate plates 52*a*, 54*a* are removably fastened on shaft 50 in a conventional manner i.e. bolts.

In use, hitch eye 50*a* is positioned on the conventional hitch assembly (not shown) of towing vehicle T. Plates 50*b*, 52*b* and 54*b* are pivotally attached to pivot plates 21 on frame 12. Any conventional and suitable pivot devices may be utilized to form the attachments. The weight rack may be loaded with the requisite amount of weight and the device is ready to be towed over the tundra to compact the loose snow and frost thereon.

It is to be understood that the present invention is not limited to the sole embodiment described above, but encompasses any and all embodiments within the scope of the following claims.

I claim:

1. A vehicle for compacting loose snow and frost, said vehicle comprising:

a frame structure having a front end, a rear end and an upper surface, said frame structure including a pair of spaced parallel frame members, each frame member of said pair having a front face and a rear face;

a weight rack supported on and spaced above said upper surface adjacent said rear end;

a plurality of pivot plates, each pivot plate of said plurality of pivot plates secured to said rear face of each frame member;

a plurality of arm members including four outside arm members, each arm member of said plurality of arm members having a first end pivotally secured to a respective pivot plate;

a first row of wheels attached to said frame structure and positioned beneath said frame structure between said front end and said rear end;

a second row of wheels attached to said frame structure and spaced from said first row of wheels at a position beyond said rear end; and a backstop member positioned on each of said four outside arm members for limiting the vertical movement of said four outside arm members, each said backstop member comprising an open structure having spaced side walls and a plurality of plates spanning the space between said sidewalls and attached to said side walls, each said backstop member being welded to the frame structure adjacent a respective outside arm member.

2. A vehicle for compacting loose snow and frost as recited in claim 1, including an axle mounted on each wheel of said first row of wheels and said second row of wheels;

each arm member of said plurality of arm members terminating in a second end, wherein each said second end is rotatably mounted to a respective axle.

3. A vehicle for compacting loose snow and frost as recited in claim 1, including means for biasing said first row of wheels and said second row of wheels in a direction away from said frame structure.

4. A vehicle for compacting loose snow and frost as recited in claim 3, wherein said means for biasing comprises a torsion spring mounted on each of said plurality of arm members.

5. A vehicle for compacting loose snow and frost as recited in claim 1, including a series of tensioning devices welded to each frame for adjusting the tension of the torsion spring.

6. A vehicle for compacting loose snow and frost as recited in claim 1, wherein each row of said first row of wheels and said second row of wheels consists of seven wheels.

7. A vehicle for compacting loose snow and frost as recited in claim 1, including a towing tung pivotally attached to one of said pair of spaced parallel frame members.

* * * * *